United States Patent [19]

Dooley

[11] Patent Number: 4,798,390

[45] Date of Patent: Jan. 17, 1989

[54] VOLLEYBALL SPIKING TEE

[76] Inventor: James E. Dooley, 3020 Minnesota Dr., #3, Anchorage, Ak. 99503

[21] Appl. No.: 905,063

[22] Filed: Sep. 8, 1986

[51] Int. Cl.[4] ..... A63B 69/00

[52] U.S. Cl. ..... 273/411; 273/1.5 A

[58] Field of Search ..... 273/411, 29 A, 1.5 A, 273/201; 221/194, 195

[56] References Cited

U.S. PATENT DOCUMENTS 2,939,705 6/1960 McCall, Jr. ..... 273/1.5 A
3,897,950 8/1975 Keller ..... 273/411
4,022,471 5/1977 Keller ..... 273/411

FOREIGN PATENT DOCUMENTS 2547457 4/1977 Fed. Rep. of Germany ..... 273/411

*Primary Examiner*—William H. Grieb
*Attorney, Agent, or Firm*—Christensen, O'Connor, Johnson & Kindness

[57] ABSTRACT

A volleyball storage and dispensing device, including a storage rack upon an upright post, and a ball dispensing station at its front that lightly holds a volleyball between a styrofoam stop and tips of a pair of rubber hoses.

4 Claims, 1 Drawing Sheet

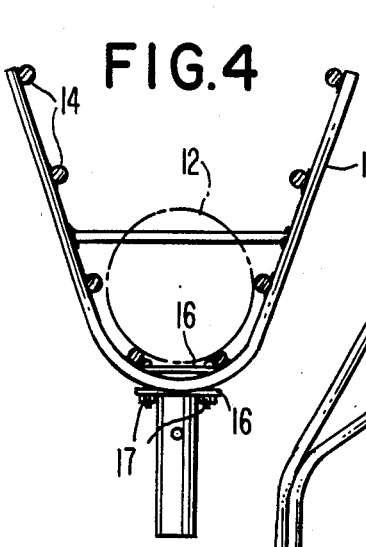
FIG.4
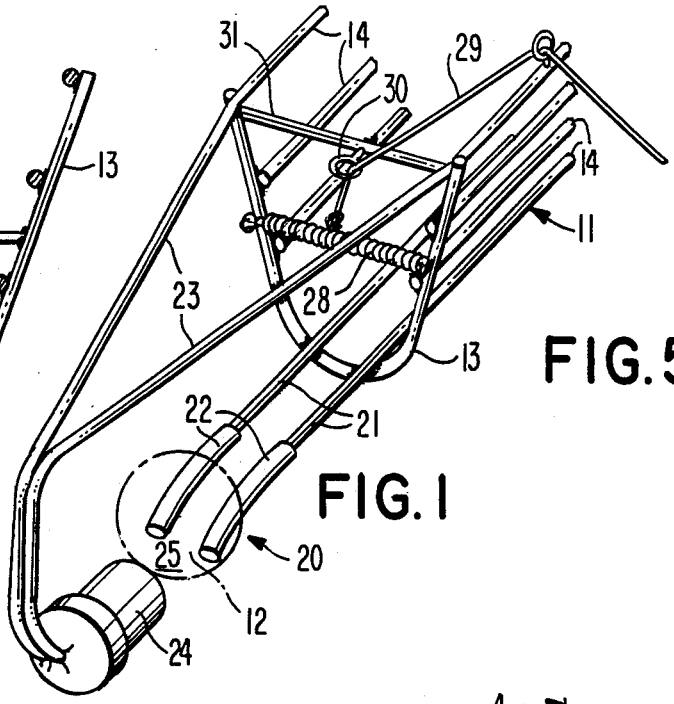
FIG.1
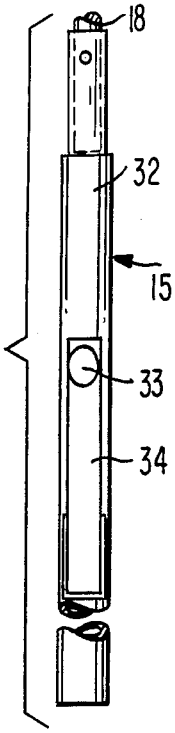
FIG.5
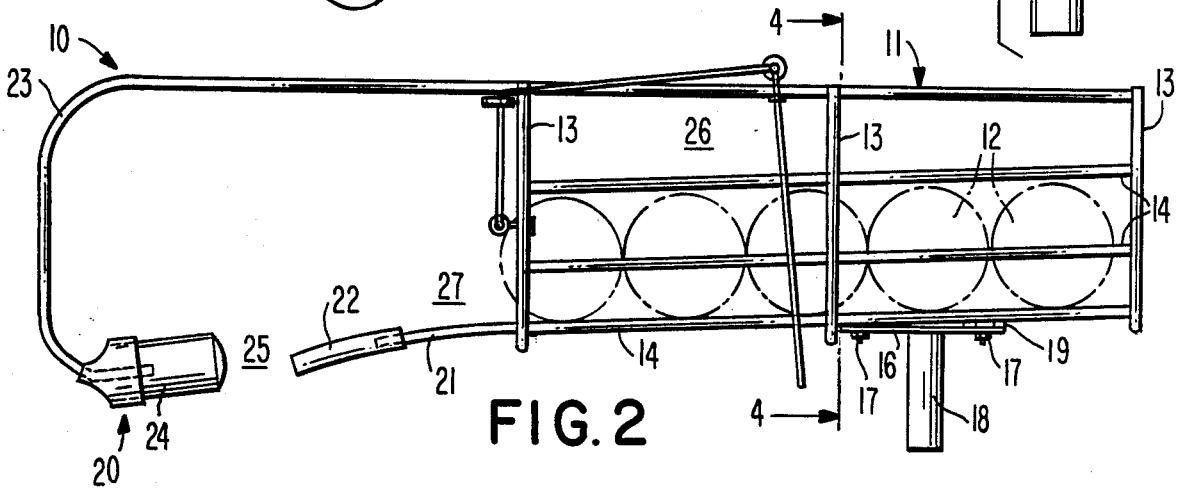
FIG.2
FIG.3
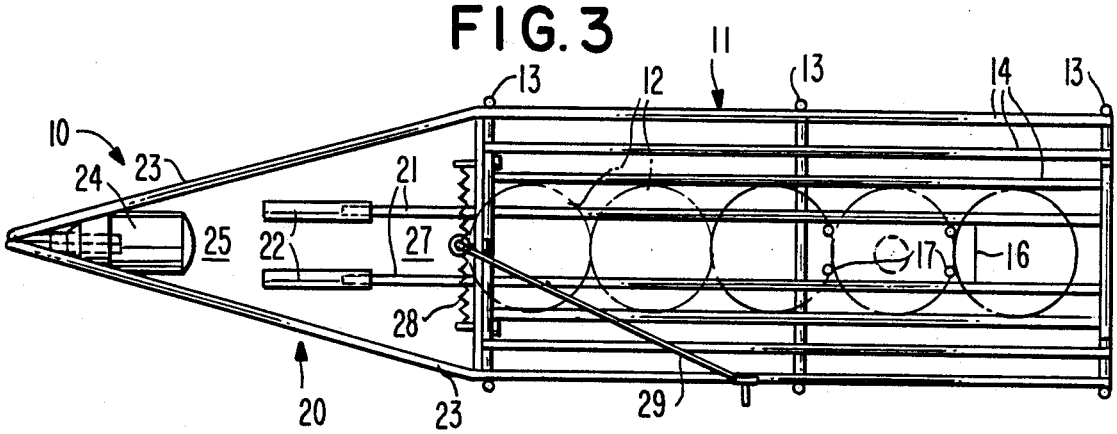

VOLLEYBALL SPIKING TEE

BACKGROUND OF THE INVENTION

1. Field of the Invention

This invention relates generally to aids for teaching the fundamentals of spiking and serving a volleyball. More specifically, it relates to automatic ball feeding devices.

2. Description of Prior Art

It is well known to those persons acquainted with the sport of volleyball that a teaching aid for this purpose has been developed in the past and is available on the market. It teaches correct arm swing, extension, approach and jump technique to learning players and corrects poor habits of advanced players. However, the device is a manually worked by a second person replacing a volleyball thereupon after each spiking action by a player. This is accordingly in need of an improvement.

SUMMARY OF THE INVENTION

Therefore, it is a principal object of the present invention to provide a volleyball spiking tee that accomplishes all the same teaching fundamentals described above, and which additionally feeds the balls automatically so that no second person is needed for reloading the device after each spiking action; and which can be all done by the player alone before he starts to play.

Other objects are to provide a volleyball spiking tee which is simple in design, inexpensive to manufacture, rugged in construction, easy to use and efficient in operation.

These and other objects will be readily evident upon a study of the following Specification and the accompanying Drawing.

BRIEF DESCRIPTION OF THE DRAWINGS

FIG. 1 is a fragmentary perspective view of a spiking machine, shown in accordance with the present invention;

FIG. 2 is a side elevational view of the invention;

FIG. 3 is a top plan view of the invention;

FIG. 4 is a cross-sectional view, taken along line 4—4 of FIG. 2, and

FIG. 5 is a longitudinal view of an adjustable support post, used in conjunction with the invention.

DETAILED DESCRIPTION

Referring now to the Drawing in greater detail, the reference numeral 10 represents a volleyball spiking tee incorporating the invention wherein there is a cage or rack 11 upon which a plurality of volleyballs 12 are stored in a row. The rack is made from several spaced apart, generally "U"-shaped ribs 13 and which are attached to a plurality of elongated rods 14 extending thereacross. The ribs and rods are made of anodized aluminum and the attachment may be made by weld. The rack thus forms a chute or trough in which the balls are supported.

The rack is supported in elevated position upon a downwardly extending post assembly 15 that includes a pair of small flat plates 16 between which a portion of the lower rods are sandwiched and the plates are bolted together by bolts 17 extending therebetween. A vertically downward sleeve 18 is welded to an underside of the lower plate which extends horizontally thereupon. A spacer 19 is placed between the rear portion of the lower plate and an underside of the frame so that the frame thus inclines downwardly toward its front at approximately eight degrees so that the balls roll freely toward the front end.

A ball dispensing unit 20 is formed at the front end of the rack by means of the lowermost rods being longer so to form a pair of forwardly extending, equally spaced apart, track rails 21 upon which the balls can roll. A forward terminal end of the rails are slightly bent arcuately downward, and a rubber hose 22 is slid on each, the hoses projecting a short distance beyond the rod ends, as shown, for the balls to roll thereacross. Also the uppermost rods are made longer so to form a pair of forwardly extending arms 23 which at their terminal end are "U"-shaped and converge together for being inserted into an end of a cylindrically shaped stopper 24 made of styrofoam, and which serves to stop the forwardly rolling ball and hold it therebetween and upon the tips of the hoses which are spaced at proper distance therefrom for preventing the ball to drop down therebetween during the free roll of the ball, but from which it can be readily dislodged by the player during a playing action.

After a ball is thus removed, a next ball resting thereagainst, automatically rolls down into the discharging seat 25 formed between the face of the stopper and the hose tips.

The invention also includes means for a person to move a group of balls out of the rack storage area 26 and into the discharge area 27 ready for automatically feeding to the discharge seat. This includes a tension coil spring 28 attached across the rib at the exit end of the rack, and a nylon cord 29 attached to the center of the spring extending through an eyelet 30 on a cross-bar 31 between the upper ends of the rib, so that when the cord is pulled, the spring is lifted up out of the way, allowing balls to roll out of the rack.

The post assembly also includes a post 32 insertable into the sleeve 18, the post including a post adjustment handle 33 on a side plate 34 attached on a side of the post.

While various changes may be made in the detail construction, it is understood that such changes will be within the spirit and scope of the present invention as is defined by the appended claims.

What I now claim is:

1. A volleyball spiking tee for use in feeding a volleyball to a spike point, said tee comprising:

feed means for receiving and controllably discharging a volleyball; and support means, coupled to said feed means, for supporting a volleyball discharged by said feed means, said support means comprising means for contacting a discharged volleyball at three points lying in a roughly horizontal plane and supporting the volleyball without obstructing a vertical plane passing through the center of the volleyball and extending below the volleyball.

2. The volleyball spiking tee of claim 1, wherein said means for contacting a discharged volleyball further comprises at least one support arm resiliently deflectable from a support position when a volleyball supported by said support means is spiked.

3. A volleyball spiking tee comprising:

a rack, mounted upon a vertical post, for storing a plurality of volleyballs, said rack having a front end and being downwardly forwardly inclined to allow volleyballs to automatically roll toward said front end;

a ball discharging mechanism, positioned adjacent said front end of said rack, for allowing a volleyball stored in said rack to exit said front end of said rack; and a discharge seat, positioned adjacent said front end of said rack, for supporting a volleyball discharged from said front end of said rack by said ball discharging mechanism, said discharge seat comprising a styrofoam stopper and a pair of rubber hose tips.

4. A volleyball spiking tee for use in feeding a volleyball to a spike point, said tee comprising:

a vertical post;

a rack, mounted upon said vertical post, for storing a plurality of volleyballs, said rack having a front end that is inclinable downward to allow volleyballs to automatically advance toward said end;

a ball discharge mechanism, extending across said rack adjacent said front end in a direction roughly perpendicular to the path of volleyball advance, said ball discharge mechanism being selectively biasable between a restraint position in which volleyballs are inhibited from advancing from said rack and a discharge position in which volleyballs are allowed to advance from said rack;

a pair of parallel guide rails extending forward from the front end of said rack to define first and second support points; and a hook-shaped stop post having a main body extending forward from the front end of said rack and an end portion projecting at least partially rearwardly to define a third support point, said first, second, and third support points supporting a volleyball advanced along said guide rails from said rack without obstructing a vertical plane that passes through the center of the volleyball and extends below the volleyball.

* * * * *